US007431659B2

(12) United States Patent
Williams et al.

(10) Patent No.: US 7,431,659 B2
(45) Date of Patent: Oct. 7, 2008

(54) GOLF CLUB HEAD

(76) Inventors: David L. Williams, 319 Hampton Ct., Coppell, TX (US) 75019; Nicholas M. Middleton, 144 Meadowhead, Sheffield S8 7UF (GB)

( * ) Notice: Subject to any disclaimer, the term of this patent is extended or adjusted under 35 U.S.C. 154(b) by 68 days.

(21) Appl. No.: 10/792,968

(22) Filed: Mar. 3, 2004

(65) Prior Publication Data

US 2004/0242344 A1 Dec. 2, 2004

Related U.S. Application Data

(63) Continuation-in-part of application No. 10/112,207, filed on Mar. 28, 2002, now Pat. No. 6,634,955, which is a continuation-in-part of application No. 09/971,319, filed on Oct. 3, 2001, now Pat. No. 6,435,975, which is a continuation of application No. 09/491,570, filed on Jan. 26, 2000, now abandoned.

(60) Provisional application No. 60/452,179, filed on Mar. 4, 2003.

(51) Int. Cl.
*A63B 69/36* (2006.01)

(52) U.S. Cl. ..... 473/231; 473/238; 473/242; 473/251

(58) Field of Classification Search ..... 473/231–255, 473/286, 313–314, 268, 226, 340–341, 324; D21/736–746
See application file for complete search history.

(56) References Cited

U.S. PATENT DOCUMENTS 1,960,110 A * 5/1934 Iles ..... 473/286
2,044,838 A * 6/1936 Douglas ..... 294/19.2
2,057,821 A 10/1936 Costello
2,213,190 A * 9/1940 Haverbach ..... 294/19.2
2,465,124 A 3/1949 Quattrin
2,709,595 A 5/1955 De Vries
2,781,197 A * 2/1957 Wiley ..... 473/249
3,021,141 A 2/1962 Polsky et al.
3,300,241 A * 1/1967 Eberwein et al. ..... 294/19.2
3,310,879 A 3/1967 Brzezinski et al.
3,343,839 A 9/1967 Borah
3,374,027 A * 3/1968 Jacobs ..... 294/19.2
3,434,722 A 3/1969 Esposito
3,632,112 A 1/1972 Jacobs
3,659,856 A 5/1972 Fatur
3,708,172 A 1/1973 Rango
3,779,398 A 12/1973 Hunter
3,841,640 A * 10/1974 Gaulocher ..... 473/249
3,966,210 A 6/1976 Rozmus
4,002,343 A 1/1977 Eckert
4,135,720 A 1/1979 Lancellotti
4,138,117 A * 2/1979 Dalton ..... 473/255

(Continued)

FOREIGN PATENT DOCUMENTS

JP 07255886 10/1995

(Continued)

*Primary Examiner*—Sebastiano Passaniti
(74) *Attorney, Agent, or Firm*—Cislo & Thomas LLP

(57) ABSTRACT

Exemplary embodiments described herein are directed to golf club heads and golf clubs including a golf club head, including a body having a generally vertical planar face, a means for aligning the planar face with a golf ball, wherein the means is positioned behind the planar face, and an orifice for receiving a club shaft.

14 Claims, 5 Drawing Sheets

U.S. PATENT DOCUMENTS

| | | | | | |
|---|---|---|---|---|---|
| 4,248,430 | A | | 2/1981 | Kepler | |
| 4,315,720 | A | | 2/1982 | Ueda et al. | |
| 4,486,019 | A | * | 12/1984 | Sievers | 473/286 |
| 4,580,784 | A | | 4/1986 | Brill | |
| 4,649,651 | A | | 3/1987 | Case et al. | |
| 4,688,798 | A | | 8/1987 | Pelz | |
| 4,809,977 | A | | 3/1989 | Doran et al. | |
| 4,809,981 | A | | 3/1989 | Doran et al. | |
| 4,815,739 | A | * | 3/1989 | Donica | 473/313 |
| 4,846,477 | A | | 7/1989 | Phelan | |
| 4,909,515 | A | | 3/1990 | Redkey | |
| 4,962,927 | A | | 10/1990 | Colucci | |
| 4,976,436 | A | | 12/1990 | Serizawa | |
| 5,011,153 | A | | 4/1991 | Watkins | |
| 5,209,470 | A | * | 5/1993 | Cimaroli et al. | 473/241 |
| 5,228,332 | A | | 7/1993 | Bernhardt | |
| 5,340,111 | A | | 8/1994 | Froelich | |
| 5,351,962 | A | | 10/1994 | Lin | |
| 5,368,302 | A | * | 11/1994 | Thomas | 473/286 |
| 5,388,827 | A | | 2/1995 | Reynolds, Jr. | |
| 5,407,194 | A | * | 4/1995 | Snow | 473/131 |
| 5,409,228 | A | | 4/1995 | Botsch | |
| 5,417,426 | A | | 5/1995 | Bayer | |
| 5,441,268 | A | | 8/1995 | Shier | |
| 5,476,262 | A | | 12/1995 | Bandiero | |
| 5,524,889 | A | | 6/1996 | Rush | |
| 5,524,895 | A | | 6/1996 | Nakajima | |
| 5,533,725 | A | | 7/1996 | Reynolds, Jr. | |
| 5,595,546 | A | | 1/1997 | Masters | |
| 5,692,968 | A | | 12/1997 | Shine | |
| 5,725,441 | A | | 3/1998 | Jensen et al. | |
| 5,810,675 | A | | 9/1998 | Weathers | |
| D402,724 | S | | 12/1998 | Minami | |
| 5,885,165 | A | | 3/1999 | Krause | |
| 5,908,440 | A | | 6/1999 | McCloskey et al. | |
| 5,924,935 | A | | 7/1999 | Prewitt | |
| 6,001,026 | A | | 12/1999 | Breneman | |
| D457,721 | S | | 5/2002 | Matyas | |
| 6,435,975 | B2 | | 8/2002 | Middleton | |
| 6,634,955 | B2 | | 10/2003 | Middleton | |
| 6,702,688 | B2 | | 3/2004 | Hale | |
| 6,878,071 | B1 | * | 4/2005 | Schwieger et al. | 473/284 |
| 7,059,971 | B1 | * | 6/2006 | Schmitt | 473/285 |
| 7,086,959 | B2 | * | 8/2006 | D'Agguano | 473/282 |

FOREIGN PATENT DOCUMENTS

| | | |
|---|---|---|
| JP | 10305119 | 11/1998 |
| WO | WO 97/47364 | 12/1997 |

* cited by examiner

GOLF CLUB HEAD

CROSS-REFERENCE TO RELATED APPLICATIONS

This application claims the benefit of U.S. Provisional Patent Application No. 60/452,179, entitled GOLF CLUB HEAD, filed Mar. 4, 2003, which is hereby incorporated by reference and also is a continuation-in-part of U.S. application Ser. No. 10/112,207, filed Mar. 28, 2002, now U.S. Pat. No. 6,634,955, which is a continuation-in-part of U.S. application Ser. No. 09/971,319, filed Oct. 3, 2001, now U.S. Pat. No. 6,435,975, which is a continuation of U.S. patent application Ser. No. 09/491,570, filed Jan. 26, 2000, now abandoned.

BACKGROUND

This invention relates to golf clubs, and more particularly although not necessarily exclusively, to putters which are used in the game of golf to strike the ball along the surface of a green.

Golf is generally played on courses having eighteen or nine holes having "tees" at one end of the hole from which a ball is initially struck by a player, and a green provided with a hole therein at the alternate end. The tee and the green are separated by a fairway and the general principle behind the game of golf is to deposit the ball in the hole on the green with as few strikes of the ball as possible.

Putters may be used on the greens and on the fringes surrounding the greens to strike the golf ball towards the hole with the aim of depositing the ball in the hole. The hole is only of the order of 12 centimeters in diameter and when it is considered that putts, which term is commonly used to describe the strokes taken with a putter, may often be in excess of 12 meters (40 feet). It will be understood that great accuracy may be required to ensure that the resulting position of the ball after the stroke is at least proximate, if not within, the hole. In general, the distance of the ball from the hole is proportional to the likelihood that the putt will be missed, i.e. more putts will be required to deposit the ball in the hole.

It is well known in the game of golf that a significant element of the professional game is centered on putting, and poor putters of the ball rarely achieve successful results. Indeed the difference between the scorecards of players with equal "tee to green" ability, but different putting ability is immediately evident.

In order to strike a golf ball with a putter directionally accurately, a smooth unerring swing is required. In particular, it is generally believed that the arc along which the putter head travels as the same is taken away from the stationary ball during the "backswing," the arc which the putter head follows as it is returned to the ball to strike same, and the arc followed thereby after the ball has been struck, i.e. follow through, are to be part of the same imaginary circle whose center is approximately between the shoulders of the golfer. Furthermore, the diameter of said circle in the direction that it is desired to strike the ball must be parallel to the plane containing the legs of the player. If this were not the case, the putting stroke of the player would either slice the ball at impact from above when viewed from above, or would push the ball from below. In any event, an undesirable component of velocity would be imparted to the ball at impact with the face. The only component of velocity ideally imparted to the ball at impact is in the desired striking direction. In this case the ball simply rolls in the direction in which it was struck.

SUMMARY

Exemplary embodiments described herein are directed to golf club heads and golf clubs including a golf club head, including a body having a generally vertical planar face, a means for aligning the planar face with a golf ball, wherein the means is positioned behind the planar face, and an orifice for receiving a club shaft.

In use, according to one exemplary method, a golf club having a golf club head, including a body having a generally vertical planar face, a means for aligning the planar face with a golf ball, wherein the means is positioned behind the planar face, and an orifice for receiving a club shaft, may be utilized by positioning the planar face of the golf club adjacent to a golf ball, aligning the opening of the golf club with the golf ball, and striking the golf ball with the planar face of the club.

DETAILED DESCRIPTION

The detailed description set forth below in connection with the appended drawings is intended as a description of exemplary embodiments and is not intended to represent the only forms in which embodiments may be constructed and/or utilized. The description sets forth the functions and the sequence of steps for constructing and operating embodiments. However, it is to be understood that the same or equivalent functions and sequences may be accomplished by different embodiments that are also intended to be encompassed within the spirit and scope of the embodiments disclosed herein.

In an exemplary embodiment a recess may open to the rear face or edge of the putter. In another exemplary embodiment, the recess may be closed to form an aperture within the body of the club head. The aperture may be circular and of a diameter marginally greater than the diameter of a conventional golf ball.

In the former embodiment, the further faces or edges may be substantially parallel and perpendicular to the striking face. Furthermore, the further faces or edges may be provided substantially equidistantly from the center of the striking face, and accordingly may have the additional function of alignment means.

The head of the putter may be provided with additional alignment means that may allow the user of the putter to position the striking face squarely to the desired direction of travel of the ball before, during and after striking thereof.

Figure 1:
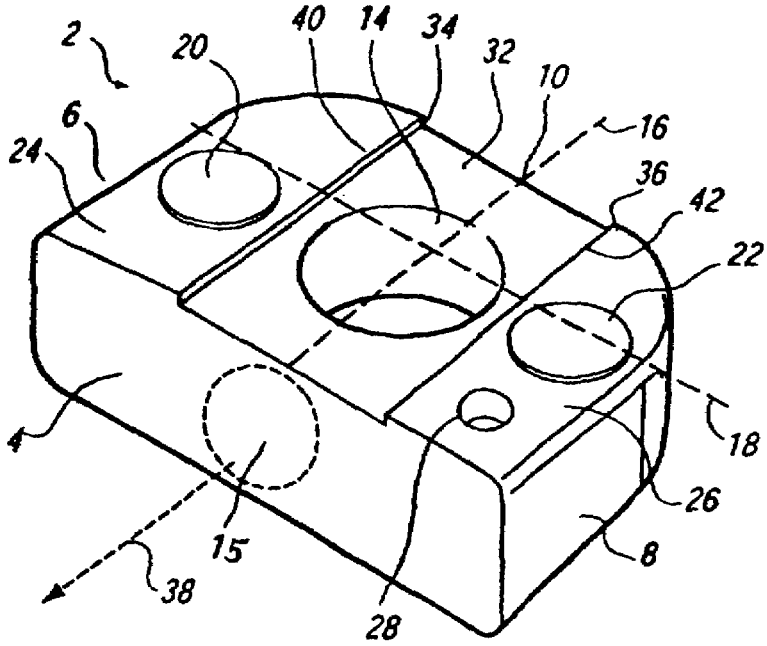
FIG. 1 shows a perspective view of a putter head according to one embodiment of the invention.

Referring to FIG. 1, a club head 2 according to an exemplary embodiment is shown, which may include a striking face 4, side faces 6, 8 and a rear face 10 which in general define a central body 12 of the head 2. A recess in the form of an aperture 14 may be provided within the body 12 and extends throughout the entire thickness thereof. It will be appreciated that although the aperture 14 is substantially symmetrically disposed within the body 12 of the head 2 about both a lateral axis 16 and a longitudinal axis 18, the precise position of the center of the aperture may be moved within the body 12 so as to be offset from either of the said axes 16, 18 according to the desired configuration, including but not limited to, position and size of the sweet spot indicated generally at 15 on the striking face 4. It will further be appreciated that altering the location of the aperture 14 may alter the dynamic and vibrational characteristics of the putter head, and such characteristics may be further altered by providing a toe weight 20 and/or a heel weight 22 in the toe or heel portions 24, 26 respectively of the head 2.

A larger "sweet spot" (that area of the striking face which when impacted causes resonant dynamics within the body of the putter head) may be achieved if the aperture 14 is provided towards the rear of the putter head body. Configuring the aperture 14 in different locations may change the characteristics of the club head 2, and may change the characteristics, including size and location, of the sweet spot 15.

Additional weighting elements may be provided in the body of the head 2 on either side of the recess 14 to provide a balanced "toe/heel" weight distribution, or other distribution, as desired. The toe 24 and the heel 26 of the putter head may be those regions generally toward the extremities of the striking face, and providing such a weight distribution across the striking face may reduce the twisting moment imparted to the putter head on impact with the ball when the point of impact is displaced from the center of the striking face.

In one exemplary embodiment, the article or object placed in the recess 14 may be placed in a "fixed" position during use so as to provide a selected effect in use of the golf club. The article or object may have a weight or weight distribution that may change the characteristics of the club when positioned in the recess, typically via any form of engagement means, methods and configurations. The article or object may be a weight that can be moved within the aperture or recess without being released therefrom, to alter the weight and moment of inertia characteristics of the club head.

Henceforth, it will be understood that a large number of modifications and variations may be made to the head 2 as desired and one such modification may be to provide one or more additional apertures in the golf club head which can operate in a similar manner as herein described with respect to aperture 14.

Figure 3:
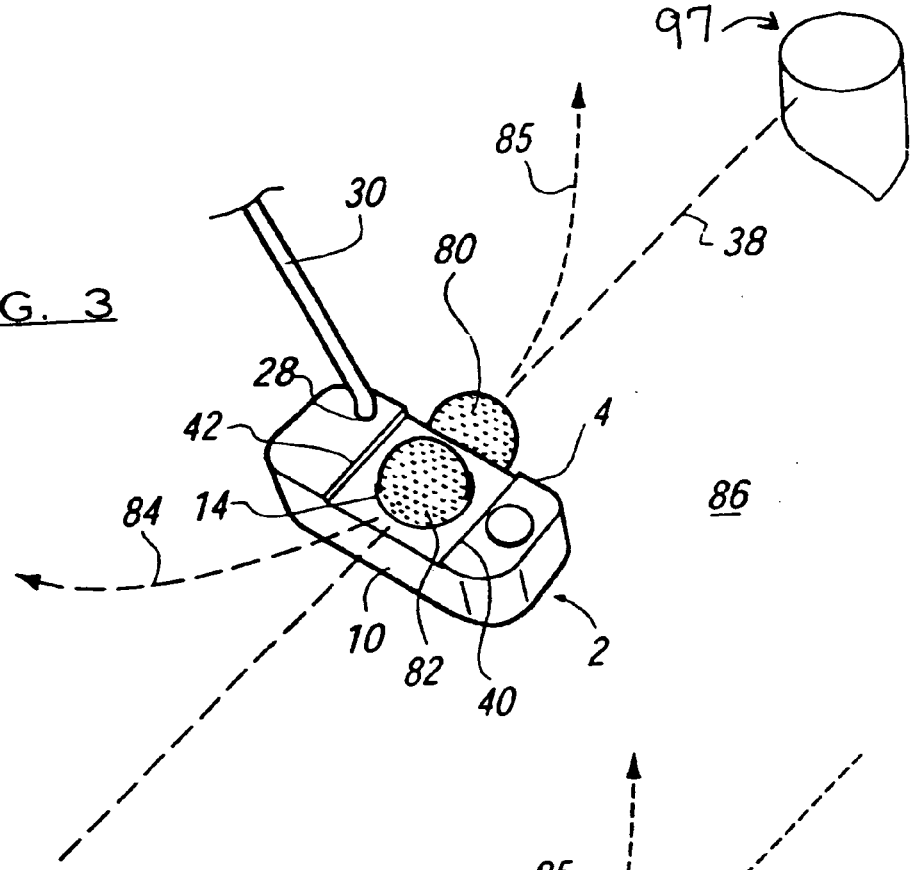
FIGS. 3 to 5 show perspective views of the mode of operation of club utilized as a training device according to exemplary embodiments.
Figure 4:
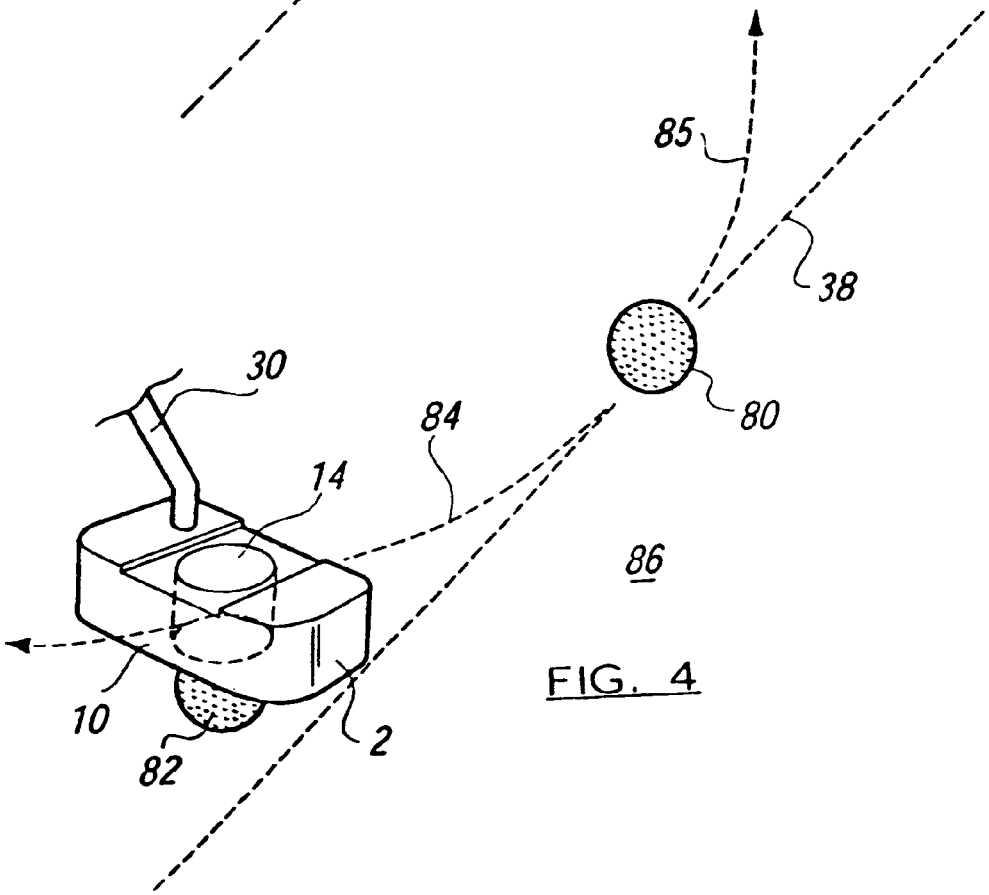
Figure 5:
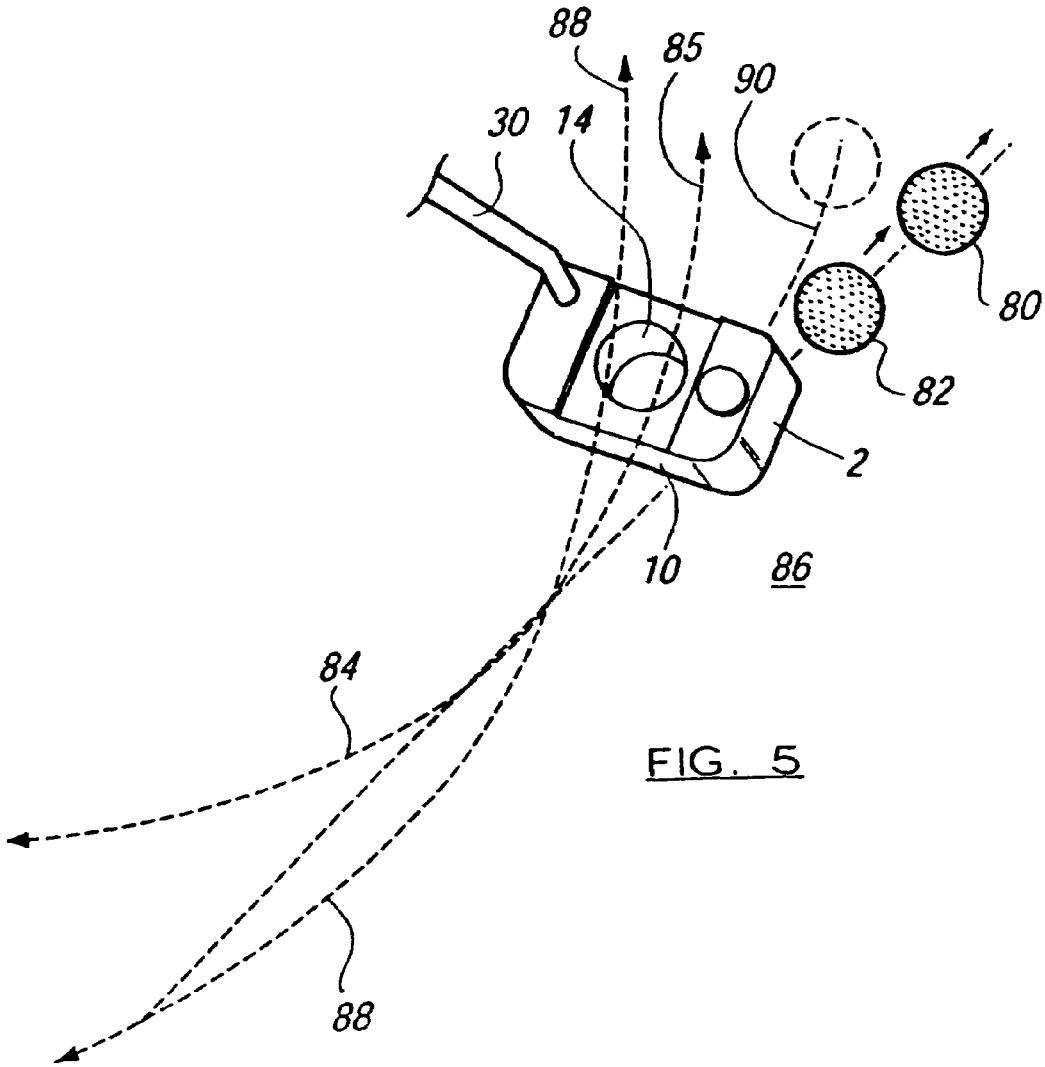

The heel region 26 may be further provided with a location 28 to which a shaft may be connected to allow the club to be swung by a user. Such a shaft is shown in FIGS. 3 to 5 at 30. Although the putter head of FIG. 1 is shown as a mallet-type putter head, it will be appreciated that a wide variety of shapes, such as but not limited to, a blade-type head, among others, may be employed. Another embodiment may be directed to other golf clubs such as for example a driver or golf club "woods," or "irons," among others.

Preferably the club may conform to the regulations concerning putters of the Royal and Ancient (R&A) Golf Association. In one embodiment the club may be a putter, which may be used in competitions. Other training devices may be impossible to use in competition or may not conform to the regulations of the R&A. Henceforth the uniformity of putting stroke acquired during training utilizing exemplary embodiments may not be immediately lost once playing on the golf course, as may be the case with current training means employed by golf professionals.

In one embodiment, the putter head of FIG. 2 may be further provided with a channeled region 32 having edges 34, 36 which is set back from the upper surfaces of the toe and heel portions 24, 26. The putter provided with such a feature may be aligned with the desired direction of travel of a ball struck by the striking face 4 as shown at 38, as the channel sides 34, 36 define discreet edges 40, 42 which are substantially parallel with the desired striking direction 38, toward hole or cup 97, and substantially perpendicular to the striking face 4.

Figures 2A, 2B, 2C, 2D:
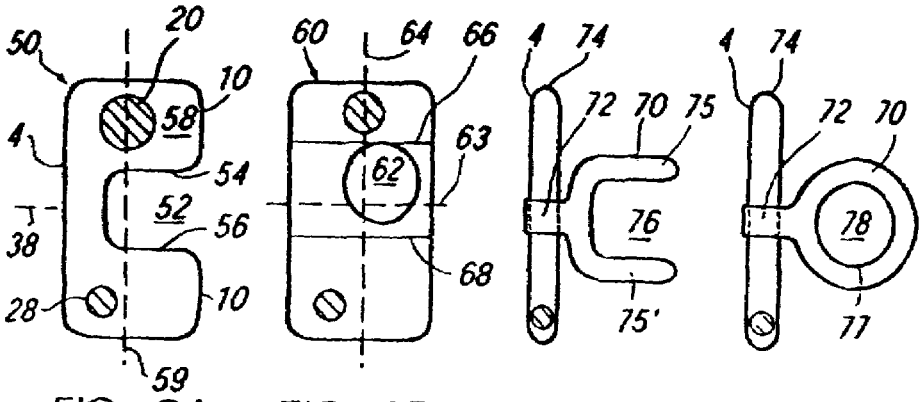
FIGS. 2A and 2B are plan views of club heads according to other exemplary embodiments.
FIGS. 2C and 2D are plan views of an attachment according to other exemplary embodiments.

Referring now to FIGS. 2A and 2B, other exemplary embodiments of a putter head 2 are shown. In FIG. 2A, a putter head 50 is provided with a U-shaped recess 52 in the rear face of the putter head 2. Correct alignment of the putter may be achieved as a result of the further internal faces 54, 56 which define the recess 52, as the faces 54, 56 define edges in the uppermost surface 58 of the putter head which are both parallel with the desired direction of striking, and perpendicular to the striking face 4 in similar manner to the edges 40, 42 described above in relation to FIG. 1.

A further putter head 60 is shown in FIG. 2B and is provided with an aperture 62, the center of which may be offset from both the lateral axis 63 and the longitudinal axis 64. Alignment means 66, 68 may be provided in a similar manner to that described in relation to FIG. 1.

A primary characteristic of exemplary embodiments may be that the recess in whatever form may be of marginally greater relevant dimensions than the diameter of the article to be received therein, such as a an article in the form of a conventional golf ball, and accordingly such a golf ball can be received in a toleranced manner in the apertures and recess. In the case of the recess 52, the distance between the edges 54, 56 may be marginally greater than the diameter of a conventional golf ball, whereas the diameter of the circular apertures 14, 62 may be marginally greater than the golf ball diameter. Accordingly, the apertures and recess may prevent significant movement of the golf ball in the direction of the longitudinal axes 18, 64, and in the case of FIG. 2A, 59, during the back swing and follow through of the putter stroke. This feature is more fully explained with reference to FIGS. 3 to 5.

Referring now to FIGS. 2C and 2D, alternative embodiments may be disclosed in which an attachment 70 may be provided with attachment means or configuration 72 which may not interfere with the striking face 4 of a putter head 74. This may function in a similar manner to the apertures 14, 62 and recess 52 described in relation to FIGS. 1, 2A and 2B. In both FIGS. 2C and 2D, the relevant dimensions of the attachment 70 may be marginally greater than the diameter of a conventional golf ball, in order that such may be received within either the recess 76 defined by a pair of rearward extending limbs 75, 75' in the case of FIG. 2C, and by the internal walls 77 of a circular hoop in the case of FIG. 2D. The walls 75, 75', or 77 may prevent any significant movement of the golf ball or object in a direction parallel to the striking face 4 of the putter head during the putting stroke.

Referring now to FIGS. 3 to 5, a putter head 2 as described in FIG. 1 is provided with a shaft 30 which is gripped by a user (not shown) and aligned by a user along a desired direction of striking 38, or "line" of a direction the user would like the ball to travel in. Such alignment is crucial in accurate putting, and other strokes, and may be aided by edges 40, 42 in the upper surface of the putter head 2 which may allow a user to ascertain the orientation of the striking face 4 of the head or putter with the desired striking direction 38 or "line." It will be appreciated that the material from which the club head is manufactured may not permit the provision of a channel as described, and accordingly the edges 40, 42 may be replaced by painted lines, or other indication means, applied to the upper surface of the club face, as desired.

The walls of the recess may also be shaped to further control the retention and selected instant of release of the article during a golf swing. For example, the walls can be straight, convex or concave shaped, and in one embodiment the aperture may be provided to selectively receive one of a range of insert sleeves, each having a different inner wall shaping and thereby allowing the characteristics of the recess to be altered for different training requirements.

During play on a golf course, obviously no marking of the desired striking direction may exist and the user may have only the alignment edges 40, 42 to aid the alignment of the club such that the striking face 4 is exactly, or very close to, perpendicular with the imagined desired striking direction.

In one method, in order to train using the putter head 2 with one recess therein, a pair of golf balls 80, 82 may be provided, the first golf ball 80 may be positioned in front of the striking face 4 and the second of the golf balls 82 may be disposed within the aperture 14 provided in the putter head 2. The aim of the putting training device may be to ensure both that close to exact or exact perpendicularity is achieved between the striking face 4 and the desired striking direction 38 during impact between the striking face 4 and the ball 80, and furthermore to ensure that a correct arc of swing is achieved by a user during every putting stroke.

As shown in FIG. 4, the putter head 2 has been drawn back from the ball 80 along a back swing arc 84 to the position shown. It can be seen from the figure that the ball 82 is supported only by the ground 86 on which the training is being conducted and accordingly as the putter head may be rotated about the back swing arc 84 and may rise above the ground 86. The ball 82 may drop from within the aperture 14 due to the force of gravity, but may be nevertheless confined to travel along the line of the desired striking direction 38. It may be seen from the figure that at the extremity of the back swing of the user, the putter may be of such a thickness that the ball 82 may not completely release from within the aperture 14, but may be partially retained by the walls of said aperture approximate the lowermost surface of the putter head 2.

It may be a common flaw of players who are poor putters to break their wrists during the putting stroke and also to concentrate too specifically on the point of impact as opposed to the arc of swing which gives rise to an accurate direction of strike.

With regard to the first flaw, although not shown in any of the diagrams, the arms and wrists of the player ideally remain rigid throughout the putting stroke, with only the shoulders rotating to effect the stroke, and in this manner a uniform and accurate direction of strike is achieved. This "pendulum effect" may increase the repeatability of a user's stroke or swing. The breaking of the wrists during the stroke results in the putter head rising above the ground during the backswing and follow through to greater degree than when the arms and wrists of the player remain rigid. The training device may allow a poor putter to quickly correct this deficiency because the ball 82 may be released from within the aperture if the wrists of the player break during the stroke, whereas during a correctly executed stroke, the wrists would not break and the putter head may rise above the ground 86 only gradually and to a lesser degree. It is to be further pointed out that the putter according to exemplary embodiments may be used as a training device with only a single ball 82, and in such configuration may be used simply to hone the putting stroke of the player by ensuring that the player retains the ball 82 within the aperture 14 at all times during a stroke.

With regard to the second flaw, the training device according to exemplary embodiments may defocus the mind of the user from the impact between the striking face and the ball, and indeed such impact need not actually occur (as discussed above there is no need to provide an object ball 80 which is to be struck by the putter). This form of training may be invaluable in teaching players to "swing through the ball" without concentrating specifically on the impact of the face therewith. In most sports, the mental approach of doing more than is actually required, for example in sprinting where sprinters run towards a point past the line, may be believed to result in improved performance. Accordingly exemplary embodiments of the training device may accomplish this.

As the putter head begins its down swing from the position shown in FIG. 4 to the position shown in FIG. 5, the ball 82 may remain enclosed within the aperture 14 until such time as the head 2 is raised a distance at least equal to the diameter of the golf ball 82 above the ground 86. At this stage, the ball 82 may be released from within the aperture 14, and as a result of the angular velocity of the putter head 2 at this time, the ball 82 may be imparted with a forward velocity directly proportional to the angular velocity of the putter head 2. It will be appreciated that, as the putter head 2 is returned from the position shown in FIG. 4 to the stationary position of FIG. 3, the striking face 4 impacts the ball 80 and thus imparts a forward velocity to the ball. On account of this impact, and the fact that the angular velocity of the putter head after impact is generally lower than that at impact, the ball 82 may have imparted thereto a lower velocity than the ball 80, and accordingly will lag somewhat behind the ball 80.

The putter head described may function as a training device in that it may be possible for a user of the putter provided with a putter head 2 to ascertain whether the arc of the follow through as shown at 85 is in the correct plane. If this is the case, then the direction of the velocity imparted to ball 82 may be identical to that direction in which ball 80 is already traveling, and ideally both of these directions may be identical to the desired striking direction 38.

A common fault of poor putters of the golf ball may be the tendency to drag the putter head toward the body after striking the ball 80, and in such circumstances the putter head 2 would follow a path indicated generally by the dotted line 88. If a player whose arc of swing of the putter head 2 is habitually along an incorrect path such as 88, the fault of that player will be immediately evident on using the training device according to exemplary embodiments because although the ball 80 may travel at least to some extent along the desired striking direction 38, the secondary ball 82 will be released from within the aperture 14 of the putter travel in a direction indicated generally by the dotted line 90. Such instantaneous appraisal of an incorrect putting arc of swing may be unlikely with currently existing putting training devices.

It will be appreciated that the putter heads shown in FIGS. 2A and 2C may operate in a different manner to the putter heads shown in FIGS. 1, 2B and 2D in that a marking on the ground 86 along the desired striking direction 38 both in front of the striking surface before and behind the putter head 2 is required. The putter head shown in FIGS. 2A and 2B may be ideally adapted to conform to the arc of swing of a player to the correct theoretical arc 84 in the back swing phase of the putting stroke. Henceforth, a ball disposed within the recesses 52, 76 may travel along the marked desired striking direction 38 away from the putter head when the head reaches the extremity of the back swing, and in the case where an incorrect arc of swing is habitually adopted by a player such as that shown at 88 in FIG. 5, the direction of travel of the ball away from the putter head will vie away from marked desired striking direction 38.

Accordingly, in another method of use, it may be possible to use the putter head shown in FIG. 1 in a training method wherein three conventional golf balls are used, two being in the positions shown of golf balls 80, 82 in FIG. 3 and a third golf ball (not shown) disposed immediately behind and adjacent the rear face 10 and also directly above a marked line indicating the desired striking direction 38. In such method, both the back swing and the follow through of the stroke of the player may be conformed to the correct theoretical arc of swing denoted by 84 and 85 by ensuring that the second golf ball 82 travels along an identical path to that taken by the ball 80 after impact. Furthermore, the swing may be evaluated or corrected by ensuring that the third golf ball moves in a direction of the marked line indicating the desired striking direction 38 but in a reverse manner to the balls 80, 82.

A number of additional features may be provided in a putter head having the configurations shown in FIGS. 1, 2A and 2B. In particular, more than a single aperture 14 may be provided, one being disposed toward the toe 24 and the other being disposed towards the heel 26 of the putter head 2. In such circumstances, a pair of golf balls may be disposed within the two apertures of the putter head which, when in use as a training device, would impart a velocity to both the golf balls disposed in the apertures on either side of a desired striking direction 38. Imperfections in the arc of swing of a player may accordingly become evident, and furthermore, such a modified putter head may be of use in assessing the particular orientation of the striking surface at impact and thereafter.

It will be appreciated that a variety of different insert or plugs which may be inserted in the aperture when the putter is being used in conventional play to provide desired dynamic and vibration characteristics which are suited to the particular player. Furthermore, a fluted aperture whose diameter varies across the thickness of the putter head, and in particular an increasing diameter of aperture from the top surface of the putter head to the bottom surface thereof may allow an earlier release of the ball 82 therefrom. This may be advantageous in testing the short putting stroke of a player, or may be used in circumstances where the arc of swing of a player is approximately correct but requires slight fine tuning.

In one embodiment, the insert may be positionally moved with respect to the head and recess. In one embodiment, when an article or object is also placed in the recess the insert can be moved to adjust the position of the object or article within the recess, and thereby allow a plurality of positions for the article in the recess.

Alternatively, the insert is itself the selectable article or object and can be positionally moved with respect to the recess so as to cause variation in the performance of the same.

Another exemplary embodiment may be provided with an elastomeric ring on the inner surface of the aperture 14 to enable a player using the putter in conventional play to lift a ball from the ground by simply urging the putter head over the ball such that it locates within the aperture and engages the elastomeric ring to be subsequently held thereby.

To enhance the overall aesthetic appearance of the putter head 2, caps may be provided to cover the aperture either on the upper surface thereof and/or on the lower surface. Such caps could be of use in identification purposes or alternatively may be provided with further alignment features to enhance the alignment capabilities of the putter head and the player as a whole.

Both caps and any insert or plugs provided within the aperture may be transparent, and indeed the entire putter head may be manufactured of a translucent material.

In another exemplary embodiment, the insert may be provided for reception in the recess and can be used as a weight. The insert may also include different weighted portions and one or more recesses provided in its uppermost surface such that a user of the putter and insert can alter, typically by rotation, the position of the insert with respect to the club head and hence alter the weight distribution when disposed within the aperture to provide the putter head with altered dynamic and vibrational characteristics to suit the particular preference of the player. In one embodiment, unwanted movement or rotation of said weight can easily be prevented by a locking device such as a grub screw tightenable against the surface of the weight using an Allen key inserted through a conveniently disposed aperture in the putter head, or other securing means and configurations.

Figure 6:
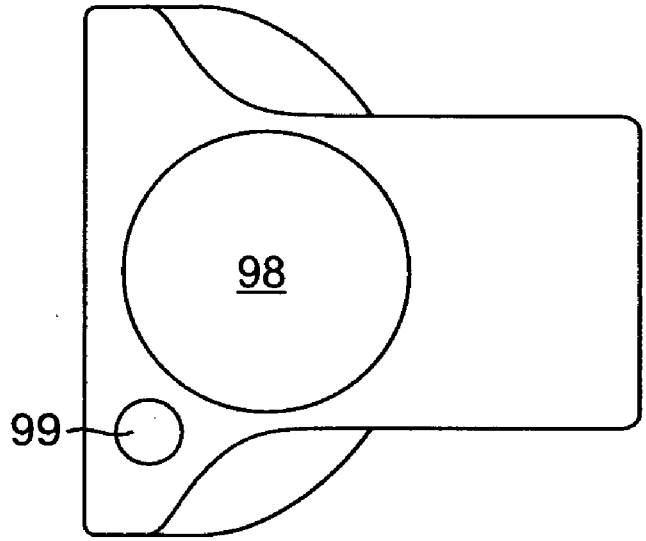
FIG. 6 is a top view of a club head according to an exemplary embodiment.

The alternate embodiment shown in FIG. 6 involves a putter head that has a polymer core 98 to dampen vibrations and reduce the overall weight of the putter head. This exemplary embodiment may include a weight or aperture 99 to increase the configurability of the head to alter its characteristics, as desired. As a result of the overall configuration of this putter head, there is a pleasing resonance when the putter head strikes a golf ball.

Figure 7:
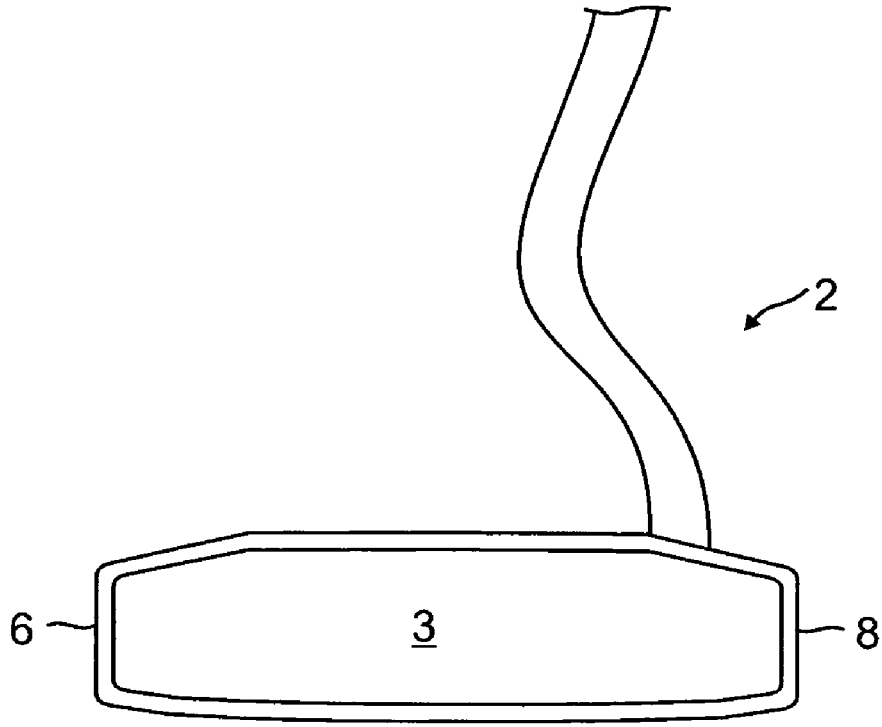
FIG. 7 is a front view of a club head according to an exemplary embodiment.
Figure 8:
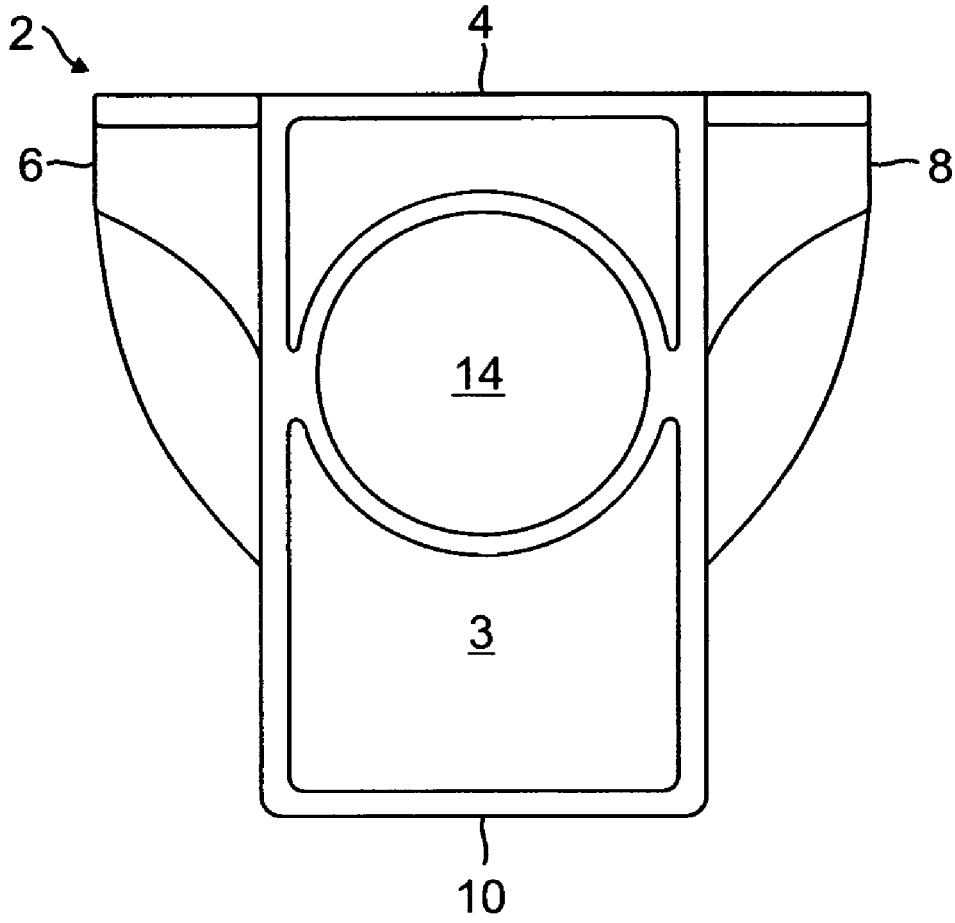
FIG. 8 is a top view of a club head according to an exemplary embodiment.

Another embodiment of the present invention is shown in FIGS. 7 and 8. In this embodiment, the putter head 2 comprises a polymer core 3 substantially surrounded on all or most sides by a durable material such as metal, composite material, or the like. The polymer core 3 may comprise either a small potion or a large portion of the overall volume of the putter head 2, including the polymer core 3 constituting a large volume of the putter head 2 surrounded by relatively thin walls on all or most sides.

The side walls of the putter head 2 may be dimensioned as shown in FIGS. 6 through 8, as well as the thickness of the wall comprising the front face, the back wall, and the walls surrounding aperture 14. In one embodiment, the sidewalls 6 and 8 shown in FIG. 8 may be approximately 1.97 mm thick as are the top and bottom walls, however, other dimensions may be utilized, as desired. The striking face 4 may have a thickness of about 4.50 mm; whereas the back wall may have a thickness of around 3.00 mm. Other dimensions may be utilized, as desired.

The resulting resonance accomplished by the polymer core 3 of the foregoing dimensions may be remarkable and unexpected. The user may encounter a very pleasant resonance effect far superior to a solid or a hollow putter head or other filled putter head of different dimensions. Furthermore, as shown in FIG. 7, a polymer 3 may be utilized as a portion of face 4 in enhance the "feel" of the user when utilizing a club according to exemplary embodiments.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawing and description are illustrative and not meant to be a limitation thereof.

What is claimed is:

1. A golf club head, comprising:

a body having a striking face, a pair of side faces adjacent to the striking face, a rear face opposite the striking face, a top surface adjacent to the striking face, the pair of side faces, and the rear face, and a bottom surface opposite the top surface;

an opening within the body extending throughout the thickness of the body, wherein the opening is sized and dimensioned to be greater than a diameter of a golf ball to receive the golf ball loosely such that the golf ball freely rolls along a playing surface during at least a portion of a swing of the golf club but so long as it remains in the opening it is restricted to moving only in the direction of the swing and only at the speed of the swing, wherein the opening is positioned behind the front surface for imparting a velocity to the golf ball during at least a portion of the swing and follow through of the golf club in the general direction of the swing and follow through and for thereafter releasing the golf ball when the golf club head is raised a distance above the ground at least equal to the diameter of the golf ball in order to hone a player's putting stroke, and wherein the opening is larger at the bottom surface of the golf club head than at the top surface of the golf club head to provide for early release of the golf ball during the swing; and an orifice for receiving a club shaft.

2. The golf club head of claim 1 wherein the opening is U-shaped dimensioned to restrict side-to-side movement of the golf ball during at least a portion of a backswing.

3. The golf club head of claim 1 further comprising an elastomeric sleeve that is weighted and moveable relative to the body to alter the size of the opening.

4. The golf club head of claim 3 wherein the sleeve is movable relative to the body to alter the location of the weight.

5. The golf club head of claim 1 wherein the front surface further comprises a polymeric insert.

6. The golf club head of claim 1 wherein at least a portion of the body comprises: a polymeric insert positioned between one or more walls composed of durable material, metal, or composite material to enhance the resonance and feel of an impact created by striking a golf ball.

7. The golf club head of claim 6 wherein said one or more walls are less than between approximately 1.97 mm and 4.5 mm thick.

8. The golf club head of claim 6 wherein said one or more walls comprise one or more side walls that are approximately 1.97 mm thick and a striking face that is approximately 4.5 mm thick.

9. A golf club, comprising:

a body having a striking face, a pair of side faces adjacent to the striking face, a rear face opposite the striking face, a top surface adjacent to the striking face, the pair of side faces, and the rear face, and a bottom surface opposite the top surface, wherein the body further comprises a front surface having a polymeric insert;

an opening in said bottom surface, wherein the opening is dimensioned and sized to be greater than a diameter of a golf ball to impart a velocity to a golf ball during at least a portion of a swing of the golf club, to allow the golf ball to freely roll along a playing surface only in the direction of the swing, and to release the golf ball when the golf club head is raised a distance above the ground at least equal to the diameter of the golf ball during at least a portion of the swing; and an attachment surface for attaching to a club shaft.

10. The golf club of claim 9 further comprising a removable weighted sleeve positioned within the opening and movable relative to the body to alter the position of the weight within the golf club.

11. The golf club of claim 9 wherein the opening is U-shaped dimensioned to receive the golf ball loosely and to restrict side-to-side movement of the golf ball during a backswing and follow through.

12. The golf club of claim 9 wherein at least a portion of the body comprises a polymeric insert positioned between one or more walls composed of durable material, metal, or composite material to enhance the resonance and feel of an impact created by striking a golf ball.

13. The golf club of claim 12 wherein said one or more walls are less than between approximately 1.97 mm and 4.5 mm thick.

14. The golf club of claim 12 wherein said one or more walls comprise one or more side walls that are approximately 1.97 mm thick and a striking face that is approximately 4.5 mm thick.

* * * * *